US011353265B2

(12) United States Patent
Rajabpour et al.

(10) Patent No.: US 11,353,265 B2
(45) Date of Patent: Jun. 7, 2022

(54) NOTCHED COOLANT TUBES FOR A HEAT EXCHANGER

(71) Applicant: Ford Global Technologies, LLC, Dearborn, MI (US)

(72) Inventors: Mahdi Rajabpour, Southfield, MI (US); Zun Wang, Novi, MI (US); Yi Zhang, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 299 days.

(21) Appl. No.: 16/027,090

(22) Filed: Jul. 3, 2018

(65) Prior Publication Data

US 2020/0011606 A1 Jan. 9, 2020

(51) Int. Cl.

| | |
|---|---|
| ***F28D 1/053*** | (2006.01) |
| ***F28F 9/013*** | (2006.01) |
| ***F28F 9/02*** | (2006.01) |
| ***F28F 1/02*** | (2006.01) |
| ***F28F 1/24*** | (2006.01) |
| ***F28F 1/12*** | (2006.01) |
| ***F28F 3/02*** | (2006.01) |
| *F28D 1/03* | (2006.01) |

(52) U.S. Cl.

CPC ..... *F28D 1/05383* (2013.01); *F28F 1/022* (2013.01); *F28F 1/025* (2013.01); *F28F 1/126* (2013.01); *F28F 1/24* (2013.01); *F28F 9/013* (2013.01); *F28F 9/0246* (2013.01); *F28D 1/0358* (2013.01); *F28F 3/025* (2013.01); *F28F 2225/04* (2013.01)

(58) Field of Classification Search

CPC ..... F28D 1/0391; F28D 1/05383; F28D 1/05391; F28D 1/05366; F28D 1/0535; F28D 1/02; F28F 1/022; F28F 1/025; F28F 1/04; F28F 2250/04; F28F 9/182; F28F 1/02; F28F 1/006; F01P 3/18; H01L 23/473

See application file for complete search history.

(56) References Cited

U.S. PATENT DOCUMENTS 4,715,432 A * 12/1987 Paikert ..... F28D 1/0391 138/40
5,704,415 A * 1/1998 Suzuki ..... F28D 15/0233 165/104.21
5,784,776 A * 7/1998 Saito ..... B21B 1/227 29/727
5,931,226 A * 8/1999 Hirano ..... F28D 1/0316 165/170

(Continued)

FOREIGN PATENT DOCUMENTS

DE 102008007597 A1 * 8/2009 ..... B21D 13/02
FR 2750485 A1 * 1/1998 ..... F28D 1/0391
JP 57174696 A * 10/1982 ..... F28F 1/045

*Primary Examiner* — Jianying C Atkisson
*Assistant Examiner* — For K Ling
(74) *Attorney, Agent, or Firm* — Geoffrey Brumbaugh; McCoy Russell LLP

(57) ABSTRACT

Methods and systems are provided for a heat exchanger for a motorized vehicle. In one example, a heat exchanger includes a plurality of tubes coupled to a header, with each tube including a partition extending a height of the tube. The partition includes a notch positioned at an end of the tube coupled to the header, with the notch extending into the tube.

16 Claims, 10 Drawing Sheets

(56) References Cited

U.S. PATENT DOCUMENTS

| | | | | |
|---|---|---|---|---|
| 6,000,461 | A | 12/1999 | Ross et al. | |
| 6,073,686 | A * | 6/2000 | Park | F28D 1/05391 165/110 |
| 6,247,529 | B1 * | 6/2001 | Shimizu | F28F 1/022 165/177 |
| 6,594,897 | B2 * | 7/2003 | Kim | B23P 15/26 165/177 |
| 6,622,785 | B2 * | 9/2003 | Haegele | F28D 1/0391 138/38 |
| 6,688,382 | B2 | 2/2004 | Hargreaves | |
| 6,874,569 | B2 * | 4/2005 | Gawthrop | F25B 39/04 165/110 |
| 9,453,599 | B2 * | 9/2016 | Young | F25B 39/00 |
| 2002/0036079 | A1 * | 3/2002 | Morel | F28D 9/0062 165/166 |
| 2005/0061494 | A1 | 3/2005 | Tsuji et al. | |
| 2005/0161206 | A1 | 7/2005 | Ambros et al. | |
| 2006/0230617 | A1 | 10/2006 | Kent et al. | |
| 2009/0050306 | A1 | 2/2009 | Helms et al. | |
| 2015/0250075 | A1 * | 9/2015 | Hirai | H01L 23/473 165/56 |
| 2017/0290199 | A1 * | 10/2017 | Chen | H05K 7/20154 |

* cited by examiner

NOTCHED COOLANT TUBES FOR A HEAT EXCHANGER

FIELD

The present description relates generally to methods and systems for a heat exchanger for a motorized vehicle.

BACKGROUND/SUMMARY

Heat exchangers for motorized vehicles are often subject to cyclic temperature changes due to fluctuations in engine coolant temperature. As the temperature of a heat exchanger changes, components of the heat exchanger may experience significant amounts of thermal stress. The thermal stress may increase a likelihood of degradation of tubes, fins, headers, or other components of the heat exchanger.

Degradation resulting from thermal stress may have an increased likelihood at locations where tubes of the heat exchanger join to a header of the heat exchanger. Some approaches to address the thermal stress include adding reinforced inserts to ends of the tubes. However, the inserts may increase a cost of the heat exchanger and may result in a pressure drop of fluid flowing through the heat exchanger.

Other attempts to address thermal stress in heat exchangers include configuring a heat exchanger to include reinforced joints. One example approach is shown by Ross et al. in U.S. Pat. No. 6,000,461. Therein, a heat exchanger assembly is disclosed including a first header, a second header, a plurality of seamed or folded type heat exchanger tubes extending between the two headers, and a plurality of heat exchanger fins. A material of the fins and headers is selected to increase a strength of joined surfaces of the headers and tubes, with the headers including a cladded surface comprised of aluminum and silicon.

However, the inventors herein have recognized potential issues with such systems. As one example, configuring the heat exchanger to include cladded surfaces may increase a material cost and/or production time of the headers and may result in an increased cost of the heat exchanger. Additionally, unjoined and/or uncladded surfaces of the components of the heat exchanger may have an increased likelihood of degradation relative to the joined surfaces.

In one example, the issues described above may be addressed by a heat exchanger, comprising: a header; and a coolant tube including first and second coolant passages arranged adjacent to one another and separated by a partition, a first end of the coolant tube coupled to the header, the partition including a notch arranged at the first end, the notch extending into the coolant tube from the header. In this way, the notch may decrease a thermal load on the coolant tube and a durability of the heat exchanger may be increased.

As one example, the notch forms a pass-through between the first and second coolant passages and extends a length into the first and second coolant passages from the header. A terminating edge of the partition is positioned at the first end of the coolant tube, and the notch separates the terminating edge from an inner surface of the cooling tube. The tube may be manufactured from a single sheet of material including cut-away portions configured to form the notch as the sheet is folded. In this way, thermal stress at the end of the coolant tube may be reduced, coolant tube durability may be increased, and a manufacturing cost of the heat exchanger may be decreased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-10 are shown to scale, although other relative dimensions may be used, if desired.

DETAILED DESCRIPTION

Figure 5:
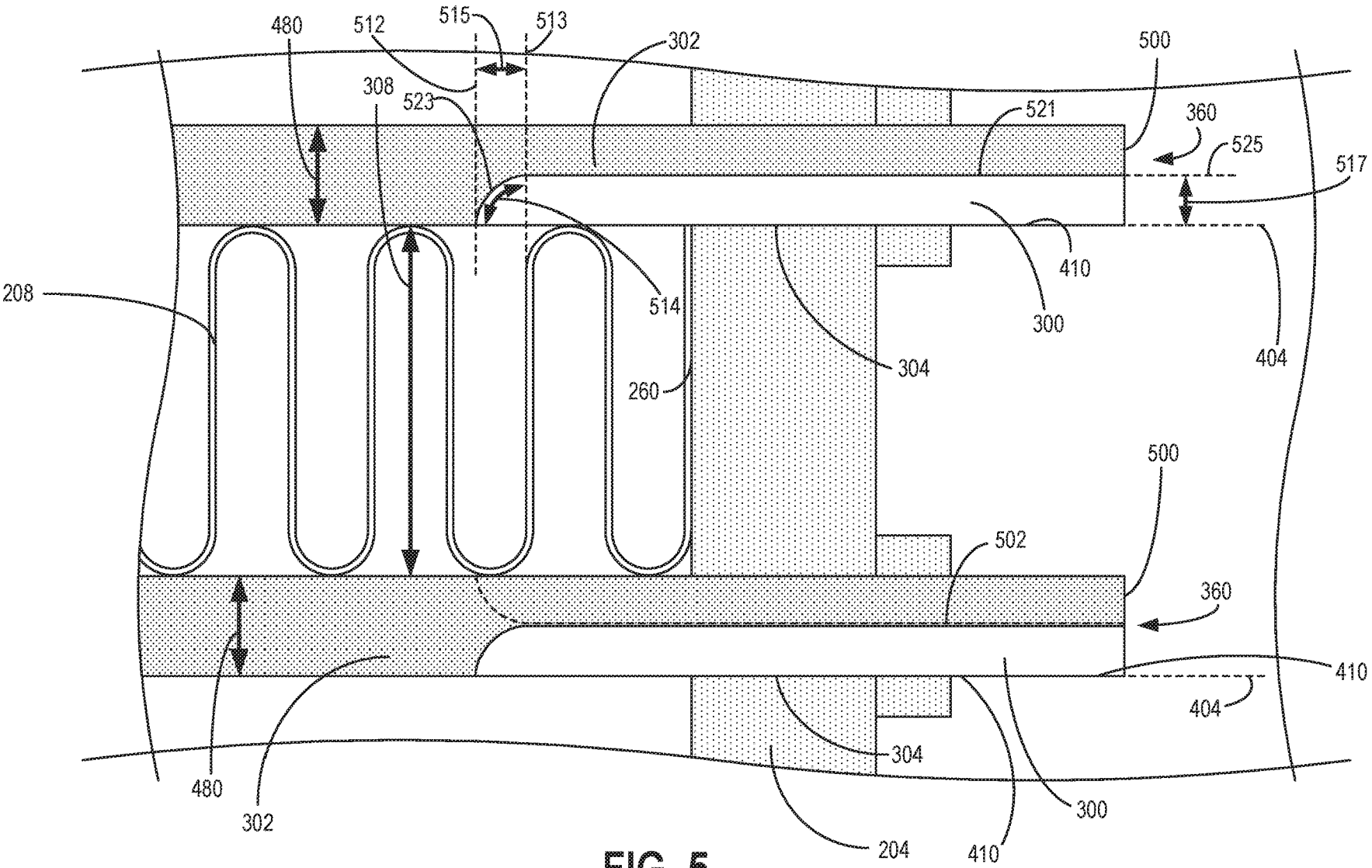
FIG. 5 shows a side cross-sectional view of notched tubes of the heat exchanger of FIGS. 2-4.
Figure 6:
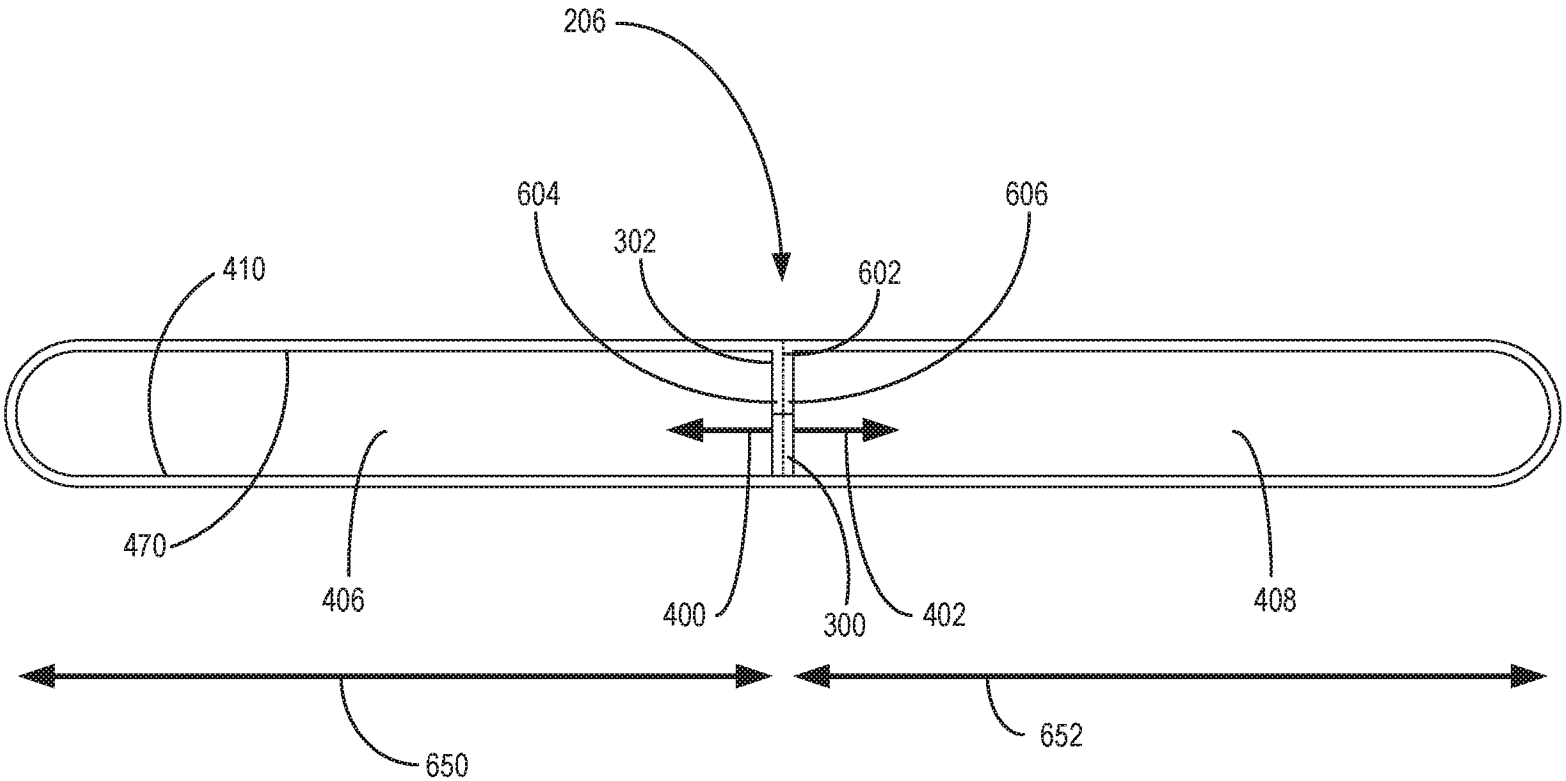
FIG. 6 shows an end view of a notched tube of the heat exchanger of FIGS. 2-5.

The following description relates to systems and methods for a heat exchanger for a motorized vehicle. A vehicle, such as the vehicle shown by FIG. 1, includes a heat exchanger, such as the heat exchanger shown by FIG. 2. The heat exchanger includes a plurality of tubes, such as the tubes shown by FIGS. 3-4. Each tube includes a first passage and a second passage separated by a partition, as shown by FIG. 6. An end of the partition of each tube is joined to a header of the heat exchanger. In some examples, the partition of each of the tubes includes a notch, such as the notch shown by FIG. 5, positioned at the end of the partition. The notch extends in a direction away from the header and extends across only a portion of a height of the partition. In some examples, a method of manufacturing a tube of the heat exchanger, such as the method illustrated by the flowchart of FIG. 11, may include forming the tube from a single sheet of material. The sheet may be folded to form the tube, as shown by FIGS. 7-10, and the sheet may include a plurality of cut-away portions that are aligned during the folding to form the notch. By configuring the heat exchanger to include the notched tubes, thermal load on the tube may be reduced. As a result, a durability of the heat exchanger may be increased.

Figure 1:
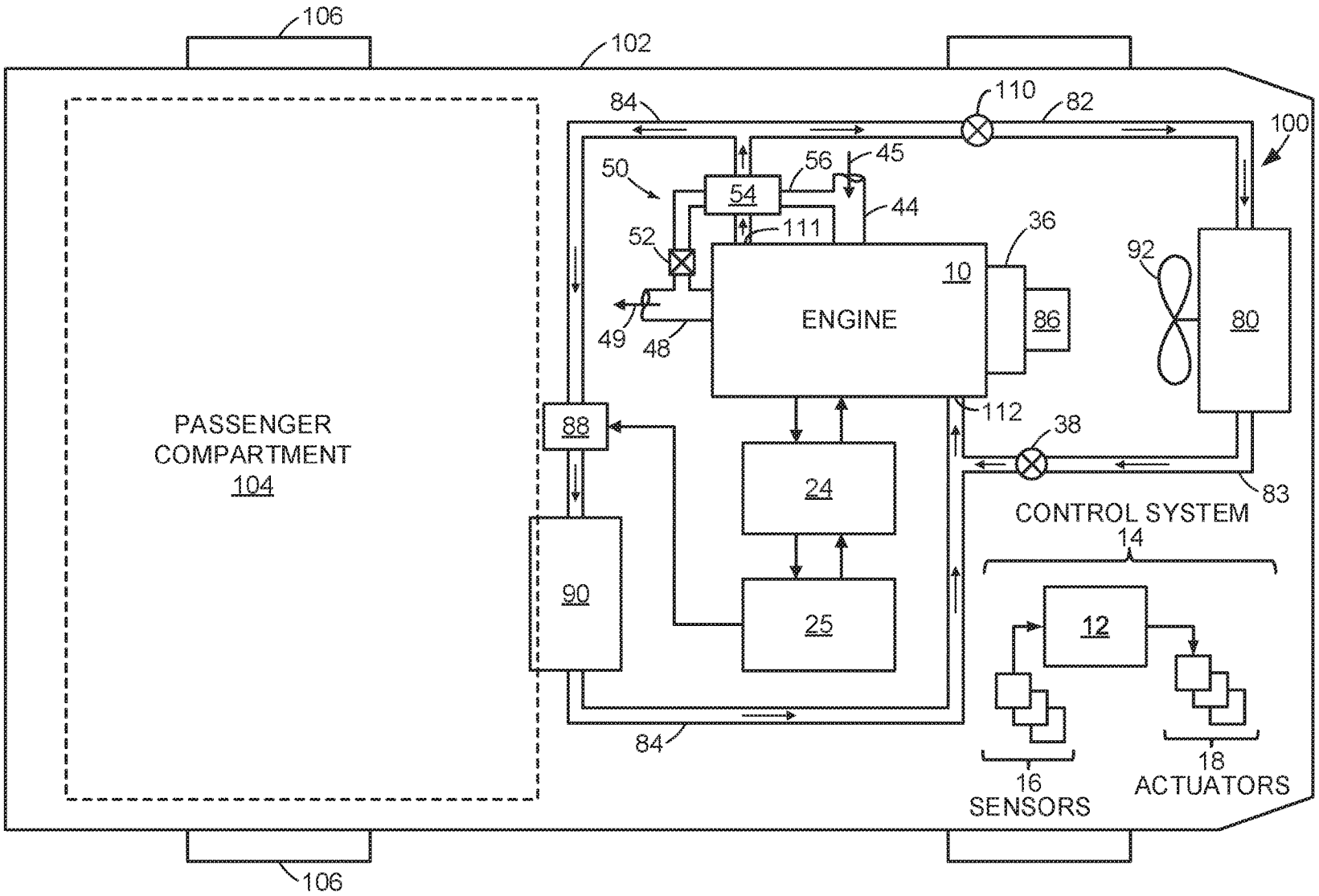
FIG. 1 schematically shows a vehicle including a heat exchanger.

Turning now to FIG. 1, an example embodiment of a cooling system 100 in a motor vehicle 102 is illustrated schematically. Cooling system 100 circulates coolant through internal combustion engine 10 and heat exchanger 80. In one example, heat exchanger 80 may be a radiator of the vehicle 102. In some examples, vehicle 102 further includes exhaust gas recirculation cooler (EGR) 54 configured to receive coolant from cooling system 100. The coolant in cooling system 100 may absorb waste heat from the engine 10, EGR cooler 54, and/or other components of the vehicle 102, and may transfer at least a portion of the waste heat to heat exchanger 80 and/or heater core 90 via coolant lines 82 and 84, respectively.

Coolant in cooling system 100 may flow from engine 10 to heat exchanger 80 via engine-driven water pump 86. Further, the coolant may flow from the heat exchanger 80 back to engine 10 via coolant line 83. In some examples, coolant from the engine 10 may flow through EGR cooler 54 prior to flowing to heat exchanger 80. In other examples, coolant may flow in parallel from engine 10 to each of heat exchanger 80 and EGR cooler 54. Engine-driven water pump 86 may be coupled to the engine via front end accessory drive (FEAD) 36 in one example, and rotated proportionally to engine speed via belt, chain, etc. The engine-driven pump 86 circulates coolant through passages in the engine block, head, etc., to absorb engine heat, which is then transferred via the heat exchanger 80 to ambient air. In an example where pump 86 is a centrifugal pump, a pressure (and resulting flow) produced may be based on (e.g., proportional to) a speed of a crankshaft of the engine, with the speed of the crankshaft (e.g., crankshaft rotational speed) being directly proportional to engine speed. A temperature of the coolant may be regulated by a thermostat valve 38, located in the cooling line 83, which may be kept closed until the coolant reaches a threshold temperature. Although EGR cooler 54 is shown by FIG. 1, in some examples the vehicle 102 may not include the EGR cooler 54. For example, coolant may flow directly from the engine 10 to the heat exchanger 80 in some examples.

Further, fan 92 may be coupled to heat exchanger 80 in order to maintain an airflow through heat exchanger 80 during conditions in which a speed of the engine 10 is relatively low (e.g., during idling conditions, such as when vehicle 102 is stopped while the engine is running, or when vehicle 102 is moving slowly during coasting conditions). In some examples, fan speed may be controlled by controller 12. Alternatively, fan 92 may be coupled to engine-driven water pump 86 and may be driven at a same speed as the engine-driven water pump 86 by the FEAD.

In some examples (as shown by FIG. 1), engine 10 may include an exhaust gas recirculation (EGR) system 50. EGR system 50 may route a desired portion of exhaust gas from exhaust passage 48 to intake passage 44 via EGR passage 56. The amount of EGR provided to intake passage 44 may be varied by controller 12 via EGR valve 52. Further, an EGR sensor (not shown) may be arranged within EGR passage 56 and may provide an indication of one or more of pressure, temperature, and concentration of the exhaust gas. Alternatively, the EGR may be controlled based on an exhaust oxygen sensor and/or and intake oxygen sensor. Under some conditions, EGR system 50 may be used to regulate the temperature of the air and fuel mixture within the combustion chamber. EGR system 50 may further include EGR cooler 54 for cooling exhaust gas 49 being reintroduced to engine 10. In such examples (as described above), coolant leaving engine 10 may be circulated through EGR cooler 54 before moving through coolant line 82 to heat exchanger 80.

After passing through EGR cooler 54, coolant may flow through coolant line 82, as described above, and/or through coolant line 84 to heater core 90 where a portion of the heat may be transferred to passenger compartment 104, with coolant flowing from the heater core 90 back to the engine 10. In some examples, engine-driven pump 86 may operate to circulate the coolant through both coolant lines 82 and 84. In other examples, such as the example of FIG. 1 in which vehicle 102 has a hybrid-electric propulsion system, an electric auxiliary pump 88 may be included in the cooling system in addition to the engine-driven pump. As such, auxiliary pump 88 may be employed to circulate coolant through heater core 90 during occasions when engine 10 is off (e.g., electric only operation) and/or to assist engine-driven pump 86 when the engine is running, as will be described in further detail below. Like engine-driven pump 86, auxiliary pump 88 may be a centrifugal pump; however, the pressure (and resulting flow) produced by pump 88 may be based on (e.g., proportional to) an amount of power supplied to the pump by energy storage device 25.

In examples in which the vehicle 102 is a hybrid electric vehicle including the hybrid-electric propulsion system, the hybrid propulsion system may include an energy conversion device 24. Energy conversion device 24 may include a motor, a generator, and/or a combined motor/generator. The energy conversion device 24 is further shown coupled to an energy storage device 25, which may include a battery, a capacitor, a flywheel, a pressure vessel, etc. The energy conversion device may be operated to absorb energy from vehicle motion and/or the engine and to convert the absorbed energy to an energy form suitable for storage by the energy storage device (e.g., provide a generator operation). The energy conversion device may also be operated to supply an output (power, work, torque, speed, etc.) to the drive wheels 106, engine 10 (e.g., provide a motor operation), auxiliary pump 88, etc. It should be appreciated that the energy conversion device may, in some embodiments, include only a motor, only a generator, or both a motor and generator, among various other components used for providing the appropriate conversion of energy between the energy storage device and the vehicle drive wheels and/or engine.

Hybrid-electric propulsion embodiments may include full hybrid systems, in which the vehicle can run on (e.g., be propelled by) only the engine 10, only the energy conversion device (e.g., motor), or a combination of both. Assist or mild hybrid configurations may also be employed in which the engine 10 is the primary torque source, with the hybrid propulsion system acting to selectively deliver added torque (e.g., during tip-in or other conditions). Further still, starter/generator and/or smart alternator systems may also be used. Additionally, the various components described above may be controlled by vehicle controller 12 (described below).

From the above, it should be understood that the exemplary hybrid-electric propulsion system is capable of various modes of operation. In a full hybrid implementation, for example, the propulsion system may operate using energy conversion device 24 (e.g., an electric motor) as the only torque source propelling the vehicle. This "electric only" mode of operation may be employed during braking, low speeds, while stopped at traffic lights, etc. In another mode, engine 10 is turned on, and acts as the only torque source powering drive wheel 106. In still another mode, which may be referred to as an "assist" mode, the hybrid propulsion system may supplement and act in cooperation with the torque provided by engine 10. As indicated above, energy conversion device 24 may also operate in a generator mode, in which torque is absorbed from engine 10 and/or the transmission. Furthermore, energy conversion device 24 may act to augment or absorb torque during transitions of engine 10 between different combustion modes (e.g., during transitions between a spark ignition mode and a compression ignition mode).

FIG. 1 further shows a control system 14. Control system 14 may be communicatively coupled to various components of engine 10 to carry out the control routines and actions described herein. For example, as shown in FIG. 1, control system 14 may include electronic controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as transmission gear position, gas pedal input, brake input, transmission selector position, vehicle speed, engine speed, mass airflow through the engine, ambient temperature, intake air temperature, etc.), cooling system sensors (such as coolant temperature, fan speed, passenger compartment temperature, ambient humidity, etc.), and others. Further, controller 12 may communicate with various actuators 18, which may include engine actuators (such as fuel injectors, an electronically controlled intake air throttle plate, spark plugs, etc.), cooling system actuators (such as air handling vents and/or diverter valves in the passenger compartment climate control system, etc.), and others.

The controller 12 receives signals from the various sensors of FIG. 1 and employs the various actuators of FIG. 1 to adjust engine operation based on the received signals and instructions stored on a memory of the controller, as described above. For example, adjusting a coolant flow through the heat exchanger 80 may include adjusting an actuator of a valve (e.g., valve 110) positioned upstream of the heat exchanger 80 and/or an actuator of a valve (e.g., valve 38) positioned downstream of the heat exchanger 80 in order to adjust the coolant flow from the engine 10 to the heat exchanger 80.

To enable coolant to flow from the engine 10 through the heat exchanger 80, the heat exchanger 80 may include a plurality of tubes. The coolant absorbs waste heat from the engine 10 and may flow through the tubes of the heat exchanger 80 in order to transfer the waste heat to components of the heat exchanger (e.g., a plurality of fins coupled to the plurality of tubes). Specifically, coolant may flow from a coolant outlet 111 of the engine 10 through the tubes of the heat exchanger 80, with the temperature of the coolant being reduced by the heat exchanger 80 and with the temperature of the components of the heat exchanger 80 being increased by the coolant. For example, fan 92 may flow air across the fins of the heat exchanger 80 in order to transfer heat from the fins to ambient air (e.g., atmospheric air). The cooled coolant then flows back to a coolant inlet 112 of the engine 10 to once again absorb waste heat from the engine 10.

The amount of waste heat transferred to the coolant from the engine may vary with engine operating conditions (e.g., engine speed). For example, as engine output torque, or fuel flow, is increased, the amount of heat generated by the engine may be increased (e.g., engine temperature may increase as output torque increases). As the temperature of the engine increases, the amount of waste heat absorbed by the coolant may also increase, and the temperature of the coolant may be increased. As the coolant flows through the heat exchanger 80, heat may flow from the coolant to the heat exchanger 80 and a temperature of components of the heat exchanger 80 may be increased as described above (e.g., thermal energy is transferred from the coolant to the components of the heat exchanger 80). By flowing heat from the coolant to the components of the heat exchanger 80, the coolant applies a thermal load to the heat exchanger 80. Specifically, the thermal load applied to the components (e.g., tubes) of the heat exchanger 80 by the coolant flowing through the heat exchanger 80 corresponds to the amount (e.g., rate) of thermal energy transferred to the components of the heat exchanger 80 from the coolant.

During conditions in which engine operating speed is high relative to idling speeds (e.g., during wide open throttle conditions), the thermal load applied to the tubes and other components of the heat exchanger 80 by the coolant may be relatively high. The increased thermal load may result in increased degradation of the tubes and/or components of the heat exchanger 80. In order to reduce the thermal load on the tubes and other components of the heat exchanger 80 (e.g., one or more headers of the heat exchanger 80), at least one of the tubes of the heat exchanger 80 may include a notch positioned at an end joined to a header of the heat exchanger 80. The notch may reduce the amount of thermal load (e.g., stresses) at an interface (e.g., joint, weld, etc.) between the tube and the header. By reducing the amount of thermal load at the interface between the tube and the header, degradation of the heat exchanger 80 may be reduced. Examples of heat exchanger tubes including notches are described below with reference to FIGS. 2-11.

Figure 2:
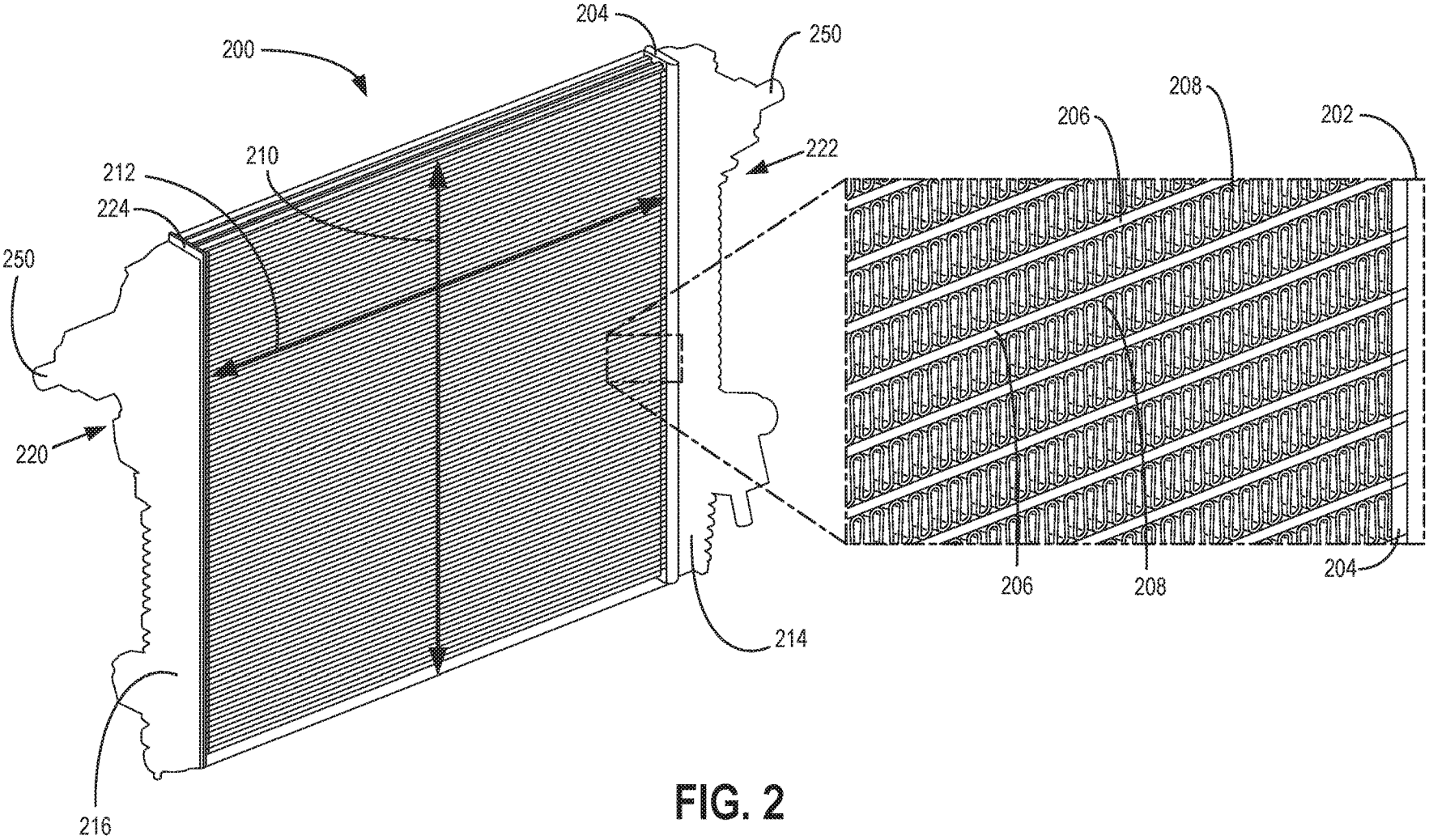
FIG. 2 shows a perspective view of a heat exchanger including a plurality of notched tubes and a plurality of fins.

FIG. 2 shows a perspective view of a heat exchanger 200. In one example, heat exchanger 200 may be similar to the heat exchanger 80 described above with reference to FIG. 1. For example, heat exchanger 200 may be included within a motorized vehicle (e.g., vehicle 102 shown by FIG. 1 and described above) and may be configured to receive coolant from an engine of the vehicle (e.g., engine 10 described above) via a plurality of tubes 206. The tubes 206 of the heat exchanger 200 are positioned parallel to each other and form a tube array extending between a first end 222 of the heat exchanger 200 and a second end 220 of the heat exchanger 200. Each of the tubes 206 extends along a length 212 of the heat exchanger 200, and each tube is offset from each adjacent tube in a direction perpendicular to the length 212 (e.g., height 210 of the heat exchanger 200) such that a clearance (e.g., gap) exists between adjacent tubes.

Inset 202 shows an enlarged view of a section of the heat exchanger 200. As shown by inset 202, the heat exchanger 200 further includes a plurality of fins 208, with the fins 208 being positioned in each clearance between adjacent tubes 206. Fins 208 are configured to receive heat from coolant flowing through the tubes 206 and may transfer heat to ambient air (e.g., atmospheric air) surrounding the heat exchanger 200. A surface area of the fins 208 may be greater than a surface area of the tubes 206 in order to increase an amount of ambient air in contact with the fins 208 (e.g., to increase an amount of heat transferred from the fins 208 to the ambient air). In one example, as shown by FIGS. 2-5, the fins 208 include a plurality of folds to increase the surface area of the fins 208. In other examples, the fins 208 may be shaped in a different way.

The heat exchanger 200 further includes a header 204 coupled to the plurality of tubes 206 (which may be referred to herein as coolant tubes, notched tubes, and/or notched coolant tubes). Header 204 may include a plurality of openings (e.g., opening 407 shown by FIG. 3), with each of the openings shaped to receive an end of one of the corresponding tubes 206. During conditions in which the tubes 206 are coupled with the header 204 via the plurality of openings of the header 204, the header 204 maintains the relative arrangement of the tubes 206 (e.g., the position of each tube relative to each other tube). For example, the openings of the header 204 adapted to receive the tubes 206 may be positioned such that during conditions in which the tubes 206 are coupled to the header 204, the tubes 206 are maintained parallel with each other (e.g., with each tube 206 extending the length 212 of the heat exchanger 200).

The ends of the tubes 206 may extend through the openings of the header 204 and into an interior of end tank 214. End tank 214 may receive coolant (e.g., coolant flowing from engine 10) and may distribute the coolant to the tubes 206. For example, inlet/outlet features 250 (shown schematically in FIG. 2) may be coupled to one or more coolant passages of an engine (e.g., coolant passage 82 of engine 10 shown by FIG. 1 and described above) in order to enable coolant to flow from the engine into the tubes 206 via end tank 214. Coolant may flow through the tubes 206 from the first end 222 of the heat exchanger 200 to the second end 220 of the heat exchanger 200. An interface (e.g., coupling interface) between header 204 and end tank 214 may be sealed (e.g., sealed by a gasket, welded, etc.) in order to reduce a likelihood of coolant flowing out of the heat exchanger 200 via the interface between the header 204 and end tank 214.

In the example shown by FIG. 2, the heat exchanger 200 includes an end tank 216 positioned at the second end 220, opposite to end tank 214 (with header 214 positioned at the first end 222). End tank 216 may be coupled (e.g., fluidly coupled) with one or more coolant return passages of the engine (e.g., coolant passage 83 shown by FIG. 1 and described above) via coupling features inlet/outlet features 250 (shown schematically by FIG. 2) to enable coolant to flow from the heat exchanger 200 back to the engine. End tank 216 is coupled to header 224, with header 224 including a plurality of openings adapted to receive ends of the tubes 206 (e.g., similar to header 204). Specifically, header 204 is coupled to the tubes 206 at the first end 222 and receives ends of the tubes 206 at the first end 222, and header 224 is coupled to the tubes 206 at the second end 220 and receives ends of the tubes 206 at the second end 220 (e.g., via the plurality of openings). An interface (e.g., coupling interface) between header 224 and end tank 216 may be sealed (e.g., sealed by a gasket, welded, etc.) in order to reduce a likelihood of coolant flowing out of the heat exchanger 200 via the interface between the header 224 and end tank 216.

Figure 3:
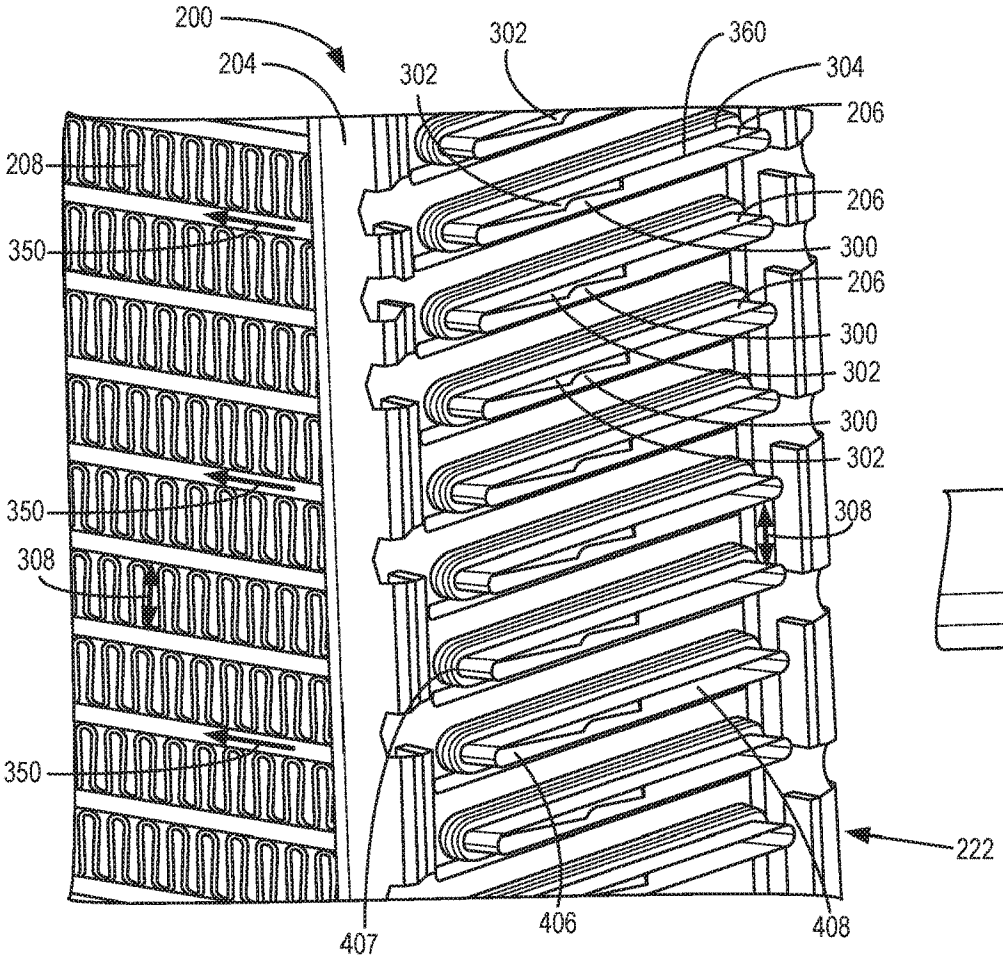
FIG. 3 shows an enlarged perspective view of notched tubes of the heat exchanger of FIG. 2, with a header of the heat exchanger partially removed.

FIG. 3 shows an enlarged view of the first end 222 of the heat exchanger 200 with the end tank 214 removed. As described above, the header 204 includes openings (e.g., opening 304) adapted to receive the tubes 206. In one example, the tubes 206 may be fixedly coupled (e.g., welded, brazed, etc.) to the header 204 around a perimeter of each of the openings of the header 204. Each opening of the header 204 encircles a corresponding tube of the plurality of tubes, and an interface between each opening and each corresponding tube may be sealed (e.g., via welding, brazing, one or more gaskets, etc.) to reduce a likelihood of coolant flowing from the end tank 214 through the openings of the header 204 without flowing through the tubes 206. Specifically, as described above, a clearance is formed between adjacent tubes due to the tubes being offset from each other by a length 308, and coolant does not flow from the header 204 into the clearances due to the sealed interface between the header 204 and the tubes 206. In this configuration, coolant flows from the first end 222 to the second end 220 (shown by FIG. 2) of the heat exchanger 200 only through the tubes 206 (e.g., as indicated by flow direction arrows 350), and the coolant does not come into contact with the fins 208.

Each of the tubes 206 includes a partition 302. The partition 302 extends an entire length of each tube 206 in a direction from the first end 222 of the heat exchanger 200 to the second end 220 of the heat exchanger 200. As described above, each tube includes a first end positioned at the first end 222 of the heat exchanger 200 (e.g., end 360) and an opposing, second end positioned at the second end 220 of the heat exchanger 200. The partition 302 of each tube extends the entire length of the tube between the first end of the tube and the second end of the tube (e.g., from a terminating edge of the tube at the first end of the tube to an opposing terminating edge of the tube at the second end of the tube).

Figure 4:
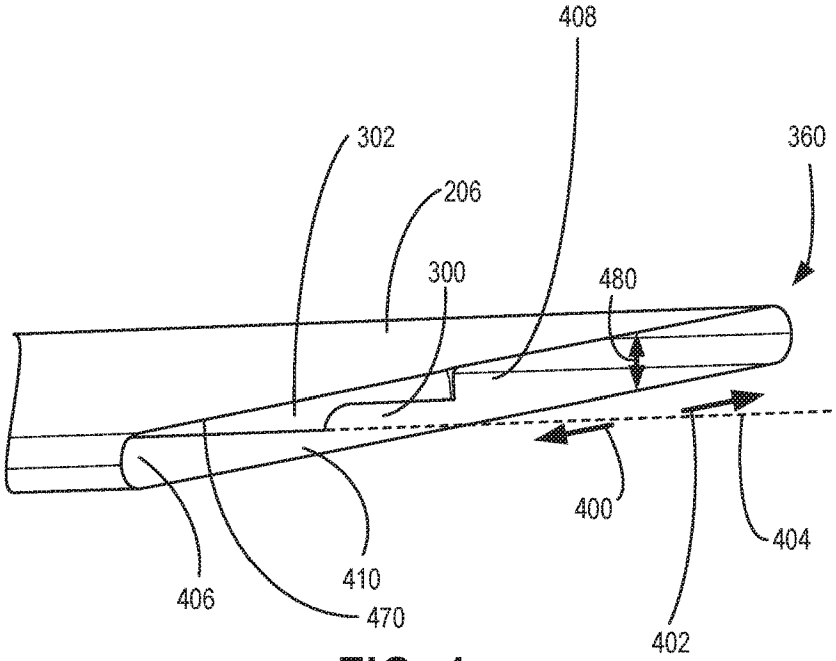
FIG. 4 shows an enlarged perspective view of an end of a notched tube of the heat exchanger of FIGS. 2-3.

An example partition 302 of example tube 206 is shown in the enlarged view of FIG. 4. The tube 206 is one of the tubes included by the heat exchanger described above with reference to FIGS. 2-3. The partition 302 separates a first passage 406 of the tube 206 from a second passage 408 of the tube 206. Each of the first passage 406 and second passage 408 are coolant passages configured to flow coolant from the first end 222 of the heat exchanger 200 to the second end 220 of the heat exchanger 200. The partition 302 is positioned along partition axis 404, with the first passage 406 being positioned at a first side 400 of the partition axis 404 within an interior of the tube 206, and with the second passage 408 being positioned at a second side 402 of the partition axis 404 within the interior of the tube 206. Partition axis 404 is arranged parallel with a direction of flow (e.g., coolant flow) through the tube 206 (e.g., the direction indicated by flow direction arrows 350, from first end 222 of the heat exchanger 200 to second end 220). The first passage 406 is separated from the second passage 408 only by the partition 302. In some examples, such as the examples shown by FIGS. 3-4 and FIG. 6, the partition 302 may be centered within the interior of the tube 206, such that a width of the first passage 406 (e.g., width 650, shown by FIG. 6) is the same as a width of the second passage 408 (e.g., width 652, shown by FIG. 6), with the width of the first and second passages being perpendicular to the partition axis 404. In other examples, the partition 302 may be not be centered and may be offset from the centered position such that the width of the first passage 406 is not the same as the width of the second passage 408.

Each partition 302 includes a notch 300. Notch 300 of example tube 206 of the heat exchanger 200 is shown in the enlarged view of FIG. 4. The notch 300 is positioned at the end 360 of the tube 206 and extends in a direction of the opposing end of the tube (e.g., the end of the tube positioned at the second end 220 of the heat exchanger 200). As shown by FIG. 4, each tube includes a lower surface 410 and an opposing, upper surface 470, with the partition 302 extending from the lower surface 410 to the upper surface 470. The lower surface 410 and upper surface 470 may be referred to herein as inner surfaces of the tube 206. Specifically, lower surface 410 and upper surface 470 are surfaces positioned within the interior of the tube 206, with each of the lower surface 410 and upper surface 470 coming into direct contact with coolant as the coolant flows through the first passage 406 and second passage 408. A height 480 from the lower surface 410 to the upper surface 470 (e.g., in a direction perpendicular to a direction of coolant flow through the first passage 406 and/or second passage 408, as indicated by flow direction arrows 350) is a same height as a height of portions of the partition 302 positioned away from the notch 300, as illustrated by FIG. 5 and described further below. The height 480 is perpendicular to the partition axis 404 and perpendicular to the width of the first and second passages (e.g., width 650 and width 652, respectively, shown by FIG. 6). The notch 300 of the partition 302 is positioned such that the partition 302 is joined to the upper surface 470 along the entire length of the partition 302 (e.g., from the end 360 of the tube 206 to the opposing end of the tube 206, with the length of the partition 302 being parallel with the partition axis 404). However, the partition 302 is not joined to the lower surface 410 along the entire length of the partition 302. Specifically, along the lower surface 410, the partition 302 does not terminate at the end 360 of the tube 206, and along the upper surface 470, the partition 302 does terminate at the end 360, as described in further detail below.

Turning now to FIG. 5, a side cross-sectional view of a section of the heat exchanger 200 is shown. The view shown by FIG. 5 is along the partition axis 404 shown by FIG. 4 and described above (e.g., the plane of the view shown by FIG. 5 is defined by the partition axis 404 and an axis extending perpendicularly from the lower surface 410 to the upper surface 470). In the view shown by FIG. 5, the tubes 206 are shown in cross-section to illustrate the position and shape of the partition 302 and notch 300. As described above, portions of the partition 302 that are positioned away from the notch 300 have the same height as the height 480 between the upper surface 470 (shown by FIG. 4 and FIG. 6) and the lower surface 410 of the tube 206. As described above, portions of the partition 302 that are positioned away from the notch 300 are joined to each of the upper surface 470 and the lower surface 410. However, at the notch 300, the partition 302 is not joined to the lower surface 410. Instead, notch 300 forms a space (e.g., a pass-through) between the partition 302 and the lower surface 410, such that the first passage 406 and second passage 408 are fluidly coupled at the notch 300 (e.g., coolant flowing through the first passage 406 and second passage 408 may mix and/or converge at the notch 300).

The notch 300 extends across only a portion of the height 480 of the tube 206 and partition 302. A remainder of the partition 302 adjacent to the notch 300 spans height 480 of the coolant tube and completely separates the first passage 406 (e.g., first coolant passage) and second passage 408 (e.g., second coolant passage) from one another. As one example, the pass-through formed by the notch 300 may be the only pass-through between the first passage 406 and second passage 408 along an entire length of the partition from the end 360 to the opposing end of the tube 206 (e.g., from first end 222 to second end 220 of the heat exchanger 200).

Although the notch 300 is shown forming a space between the partition 302 and the lower surface 410 (which may be referred to herein as a lower position of the notch 300), in other examples the notch 300 may instead form a space between the partition 302 and the upper surface 470, and may not form the space between the partition 302 and the lower surface 410. Dashed line 502 indicates an alternate position (which may be referred to herein as an upper position) of the notch 300 in which the notch 300 forms the space between the partition 302 and upper surface 470 and does not form the space between the partition 302 and the lower surface 410. In some examples, each tube 206 of the heat exchanger 200 may include the notch 300 in the position described above (e.g., the position in which the space is formed between the partition 302 and the lower surface 410) or in the alternate position shown by dashed line 502.

In the examples shown, the notch 300 is shaped such that the partition 302 includes a first surface 521 and a second surface 523 at the location of the notch 300 (as shown by FIG. 5). The first surface 521 of the partition 302 extends into the tube 206 in a direction parallel with each of the lower surface 410 and the upper surface 470, and the second surface 523 of the partition 302 extends into the tube from the first surface 521 toward the lower surface 410 with a curvature 514. In the example shown, the first surface 521 is a flat, planar surface (e.g., without curvature). In one example, second surface 523 may curve continuously with curvature 514 toward the lower surface 410. In other examples, second surface 523 may not curve with curvature 514 and may instead be a planar (e.g., flat) surface extending between the first surface 521 and the lower surface 410. As one example, second surface 523 may be a planar surface positioned perpendicular to the lower surface 410. As another example, second surface 523 may be a planar surface positioned at an angle relative to the lower surface 410 and first surface 521 (e.g., positioned at 45 degrees relative to the lower surface 410 and extending to the first surface 521).

In the example shown by FIG. 5, first surface 521 is positioned along (e.g., parallel with) axis 525. Axis 525 is parallel to partition axis 404 and is offset from the partition axis 404 by length 517. The length 517 is arranged parallel with the height 480 between the upper surface 470 and lower surface 410 of the tube 206. Length 517 may be referred to herein as a height of the notch 300. Axis 513 intersects the location where the first surface 521 is joined with (e.g., transitions to) the second surface 523, and axis 512 intersects the location where the second surface 523 is joined with the lower surface 410. Although the first surface 521 and second surface 523 are referred to herein as separate surfaces, the first surface 521 and second surface 523 are joined together (e.g., formed together) continuously (e.g., seamlessly) such that no other surfaces are positioned between the first surface 521 and second surface 523. Axis 513 is positioned perpendicular to the axis 525 and extends in a normal direction relative to upper surface 470 and lower surface 410. The axis 512 is positioned parallel with axis 513 and is offset from the axis 513 by length 515. Axis 513 is positioned externally relative to header 204 and is offset from header back surface 260 by length #. Length 515 may be sufficiently sized (e.g., being larger than 5 millimeters, in some examples) in order to reduce thermal stress at the location at which the header 204 joins (e.g., is coupled with) the tubes. Similar to axis 513, axis 512 extends in the normal direction of upper surface 470 and lower surface 410. Each of the axis 512 and axis 513 intersect the partition axis 404 and are positioned perpendicular to the partition axis 404. Further, each of axis 512 and axis 513 are positioned parallel with terminating edge 500 of the partition 302 and the length 517. The terminating edge 500 is positioned at the end 360 of the tube 206 and does not span the entire height 480 of the tube 206 due to the proximity of notch 300. The second surface 523 curves with curvature 514 from the location at which axis 513 intersects with axis 525, to the location at which axis 512 intersects the partition axis 404.

By configuring the notch 300 and partition 302 as described above, an amount of thermal stress applied to the tube 206 by coolant flowing through the heat exchanger 200 may be reduced. For example, as described above, during conditions in which the engine of the vehicle including the heat exchanger 200 is operating (e.g., engine 10 of vehicle 102 described above with reference to FIG. 1), the temperature of the coolant may change in response to changes in engine operating speed. As one example, during conditions in which the engine is relatively low (e.g., idling or coasting), the coolant flowing through the heat exchanger 200 may be at a lower, first temperature (e.g., 30° C.), and during conditions in which the engine speed is relatively higher (e.g., during wide open throttle and/or acceleration), the coolant flowing through the heat exchanger from the engine may be at a higher, second temperature (e.g., 90° C.). As the temperature of the coolant transitions from the lower, first temperature to the higher, second temperature (or vice versa), the tubes and other components of the heat exchanger 200 also transition in temperature. However, a rate at which the temperature of the tubes and other components transitions in response to the changing coolant temperature may not be the same as a rate at which the temperature of the coolant changes in response to the changing engine operating speed. As a result, thermal stress is applied to the tubes and other components of the heat exchanger 200 as the temperature of the coolant changes (e.g., fluctuates).

Further, because the ends of the tubes are coupled to header 204, additional thermal stress may be applied to the tubes during conditions in which the temperature of the tubes is not the same as the temperature of the header 204. For example, different coolant flow patterns may result from different coolant densities and/or viscosities, with the densities and/or viscosities varying with temperature. The different flow patterns may result in different amounts of coolant flowing from the engine coming into contact with surfaces of the header 204 relative to an amount of coolant coming into contact with surfaces at the ends of the tubes (e.g., end 360). As a result, the surfaces of the header 204 may be heated by the coolant by a greater amount than the surfaces at the ends of the tubes. As another example, the different flow patterns may result in coolant from the engine coming into contact with the surfaces of the header 204 for a longer duration than an amount of time that the coolant is in contact with the surfaces of the ends of the tubes, and a larger amount of heat may be transferred from the coolant to the header 204 as a result (e.g., relative to an amount of heat transferred from the coolant to the surfaces at the ends of the tubes). The different amounts of heating of the header 204 relative to the tubes may result in the header 204 being at a different temperature relative to the tubes, and thermal stress may be increased.

Hot coolant may flow through the heat exchanger 200 and increase the temperature of components of the heat exchanger 200. As the components may transition from lower temperatures to higher temperatures, the components of the heat exchanger 200 (tubes, fins, headers, etc.) may experience large and/or uneven expansion. A rate of expansion of each of the components may not be the same relative to other components in terms of magnitude and/or direction (e.g., as a result of different component shapes). This may lead to large uneven expansion of the components, which in turn may induce large thermal stresses, specifically in tube-header joint area (e.g., the region at which the tubes are joined to the header).

However, configuring one or more of the tubes to include the notch 300 as described above may reduce the thermal stress on the tubes. For example, notch 300 may decrease an amount of heating of the partition 302 by components of the heat exchanger 200 that are positioned external to the tube 206, such as the header 204. As a result, a temperature of the partition 302 at the notch 300 may be maintained at approximately a same temperature as the lower surface 410 and upper surface 470 of the tube 206 at the notch 300, and thermal stress on the tubes may be decreased. Adding the notch to one or more ends of the tubes of the heat exchanger may thermally separate the upper and lower surface of the tubes in the header-tube joint area. As a result, expansion of the header, tubes, and/or other components in this area may produce less thermal stress. Overall, durability of the heat exchanger 200 may be increased.

Turning briefly to FIG. 6, a view of the end 360 of tube 206 is shown. In some examples (e.g., as described below with reference to FIGS. 7-11), the tube 206 may be formed from a single sheet of material (e.g., a sheet of steel). For example, the single sheet may be folded in order to form the partition 302, first passage 406, and second passage 408 of the tube 206. In such examples, the partition 302 is formed by a first wall 604 and a second wall 606 joined at joint 602. Although first wall 604 and second wall 606 are described separately, the first wall 604 and second wall 606 may be a single, continuous wall forming the first passage 406 and the second passage 408 as well as the upper surface 470 and lower surface 410. For example, prior to folding of the single sheet, first wall 604 and second wall 606 may each be a single wall of the single sheet. However, the single sheet may be folded such that the single wall is layered against itself, resulting in the configuration of the first wall 604 in face-sharing contact with second wall 606 as shown by FIG. 6. The first wall 604 and second wall 606 may then be joined at joint 602. In this configuration, a thickness of the partition 302 may be at least twice a thickness of the initial, single wall (e.g., a thickness of the layered first wall 604 and second wall 606 may be twice the thickness of the initial, single wall). In one example, joint 602 may be a weld, braze, etc. fusing the first wall 604 with the second wall 606 to effectively form a single wall. In other examples in which the tube 206 is not formed from the single sheet of material (e.g., the tube 206 is formed by a different process such as extrusion, molding, etc.), the partition 302 may comprise only a single wall rather than both of first wall 604 and second wall 606 and may not include the joint 602.

In some examples, each tube of the heat exchanger 200 may include the notch 300 as described above. In other examples, one or more tubes of the heat exchanger 200 may include the notch 300, with at least one other tube not including the notch 300. In yet other examples, the notches of the tubes may each be positioned at a same end of the heat exchanger 200 (e.g., first end 222, shown by FIG. 2), with no notches of the tubes positioned at the opposing end of the heat exchanger 200 (e.g., second end 220, shown by FIG. 2). In yet other examples, the one or more of the tubes may include notch 300 positioned at the first end 222, and one or more of the tubes may include notch 300 positioned at the second end 220 (e.g., one or more of the tubes may include notch 300 positioned at end 360 shown by FIGS. 3-6, and one or more of the tubes may include notch 300 positioned at the opposing end to end 360 along length 212, with length 212 shown by FIG. 2).

Figure 7:
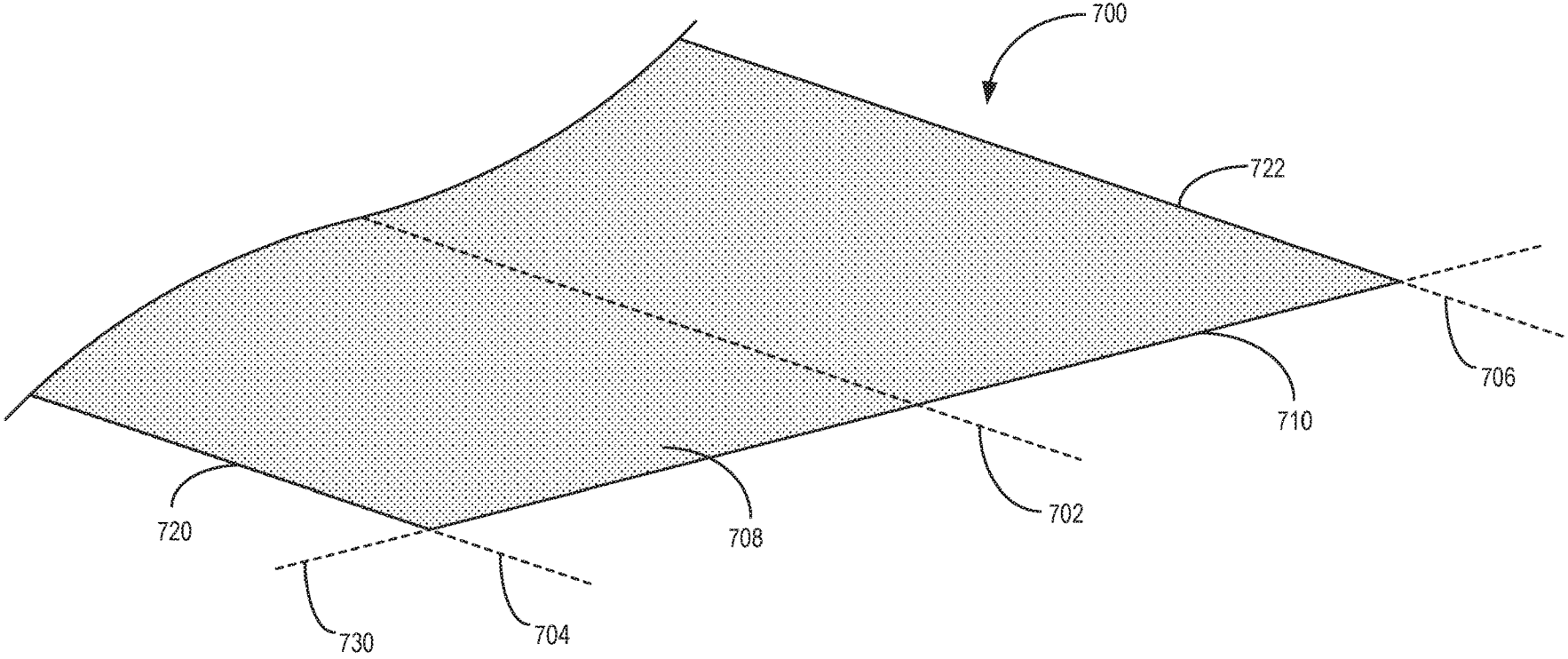
FIGS. 7-10 show perspective views of a notched tube of the heat exchanger of FIGS. 2-6 in different stages of manufacturing.
Figure 8:
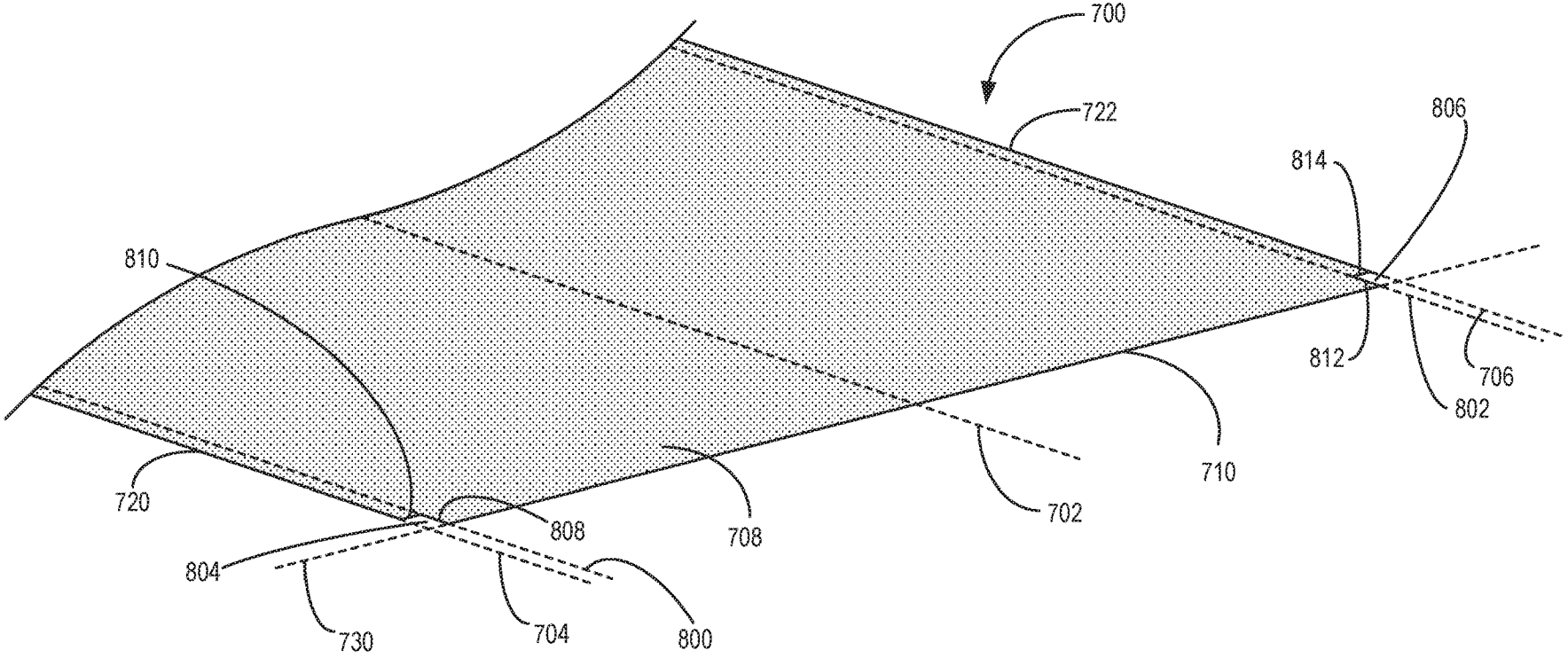
Figure 9:
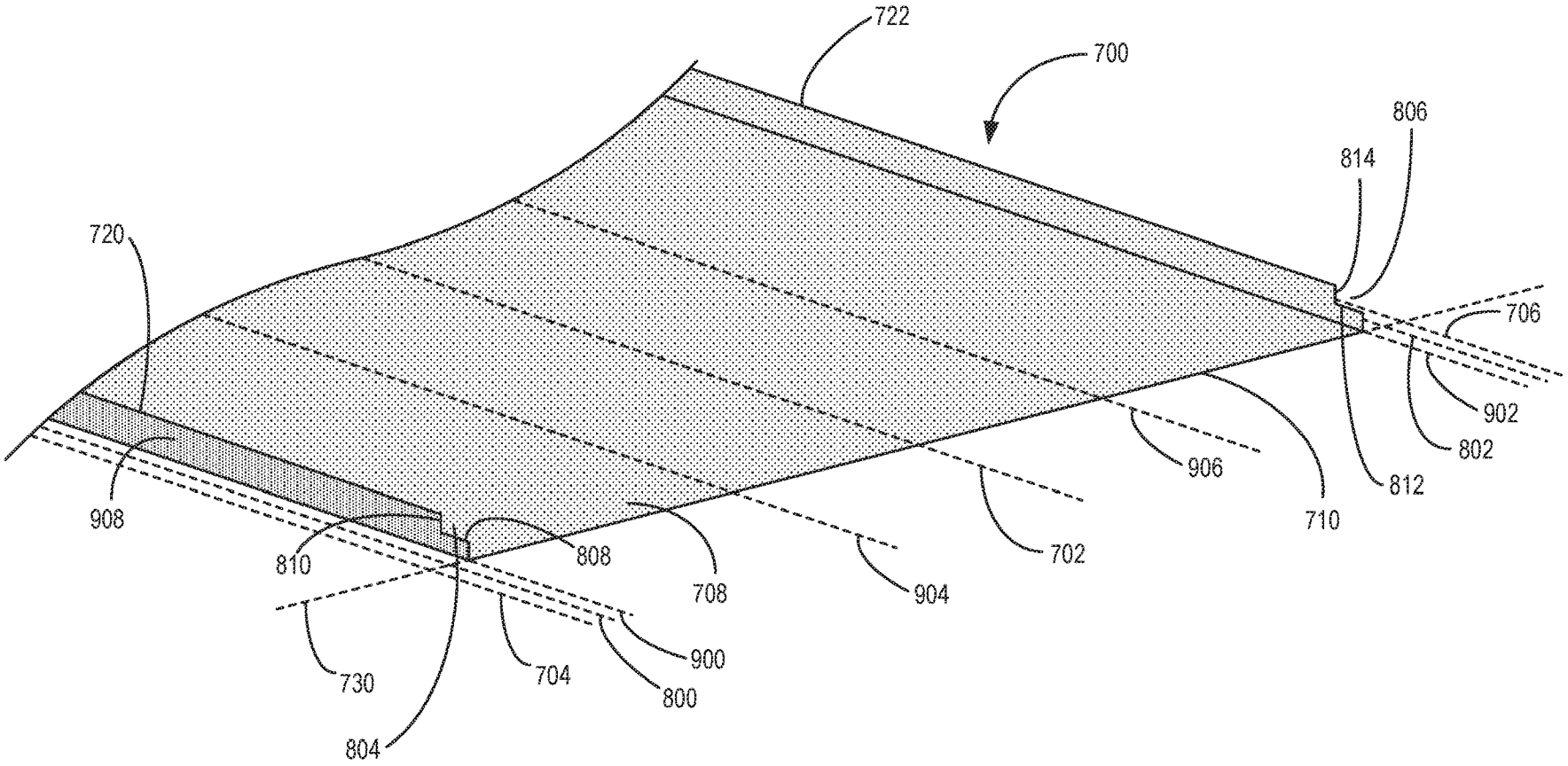
Figure 10:
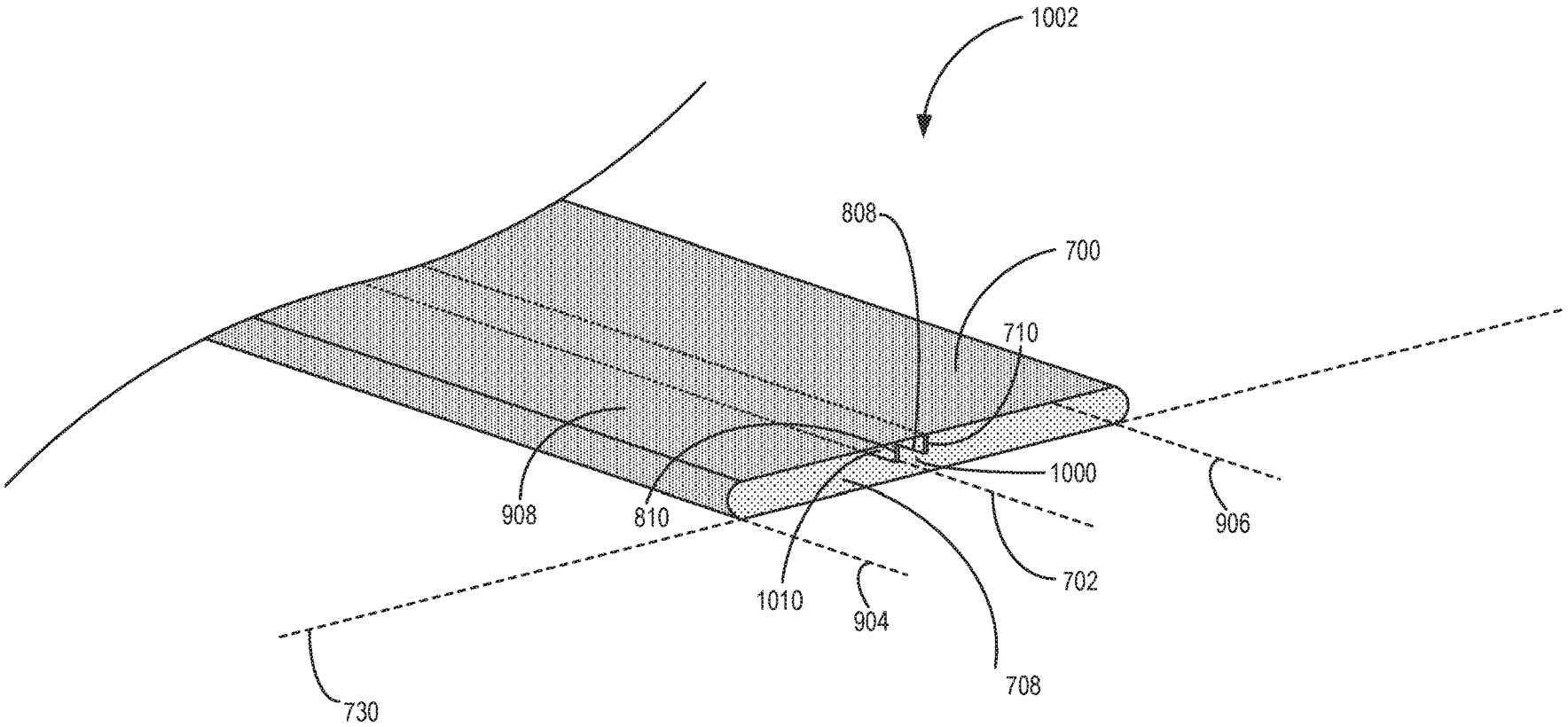

Turning now to FIGS. 7-10, various stages of manufacturing a coolant tube 1002 (shown by FIG. 10) for a heat exchanger are shown (e.g., similar to tubes 206 of heat exchanger 200 described above). Specifically, FIG. 7 shows a perspective view of a portion of a sheet 700 from which the coolant tube 1002 is formed. In the view shown by FIG. 7, the sheet 700 in an unfolded condition. FIG. 8 shows the sheet 700 with a plurality of notched portions formed at opposing corners of the sheet 700. FIG. 9 shows the sheet 700 in a partially folded configuration, and FIG. 10 shows the sheet 700 fully folded to form the coolant tube 1002. The stages of manufacturing may progress sequentially from FIG. 7, to FIG. 8, then to FIG. 9, and then to FIG. 10.

As shown by FIG. 7, the sheet 700 may be a relatively flat, planar sheet of material (e.g., metal, such as steel). The sheet 700 includes a first edge 720 and an opposing, parallel second edge 722. The sheet 700 further includes a third edge 710 extending between the first edge 720 and second edge 722 in a direction perpendicular to the first edge 720 and second edge 722. The third edge 710 may be referred to herein as a terminating edge. Axis 704 is positioned along the first edge 720 and is parallel with the first edge 720. Axis 706 is positioned along the second edge 722 and is parallel with the second edge 722. Axis 730 is positioned along the terminating edge 710 and is parallel with the terminating edge 710. In this configuration, the axis 704 and axis 706 are parallel with each other, and axis 730 is perpendicular to each of axis 704 and axis 706. Central axis 702 is positioned midway between the axis 704 and the axis 706 in the direction from the axis 704 to the axis 706. Further, central axis 702 is parallel to each of axis 704 and axis 706. In the view shown by FIG. 7 with the sheet 700 in the unfolded condition, first face 708 of the sheet 700 is visible, with the first face 708 bounded by the first edge 720, second edge 722, and terminating edge 710.

FIG. 8 shows the sheet 700 in the unfolded condition with a first notched portion 804 formed at a first corner of the sheet 700 (e.g., at the intersection of axis 730 with axis 704). FIG. 8 additionally shows a second notched portion 806 formed at a second corner of the sheet 700, opposite to the first corner (e.g., at the intersection of axis 730 with axis 706). In one example, first notched portion 804 and second notched portion 806 may be formed in the sheet 700 via cutting, stamping, etc. the sheet 700. In other examples, sheet 700 may be pre-formed with the first notched portion 804 and/or second notched portion 806 (e.g., sheet 700 may be molded or otherwise formed to include the first notched portion 804 and/or second notched portion 806 prior to being folded, as described below with reference to FIGS. 9-10).

At the first notched portion 804, sheet 700 includes edge 810 extending in a direction perpendicular to first edge 720 and perpendicular to axis 704, from the first edge 720 toward the second edge 722. Edge 810 is positioned parallel with terminating edge 710 and parallel with axis 730. The sheet 700 further includes edge 808 positioned at the first notched portion 804, with the edge 808 joined to edge 810 and positioned parallel with the first edge 720 and axis 704. The edge 808 is positioned perpendicular to the terminating edge 710 and axis 730, and extends in a direction from the terminating edge 710 of the sheet 700 toward an opposing end of the sheet 700 (not shown). Edge 808 is positioned along axis 800 and is parallel with the axis 800, with the axis 800 being parallel to axis 704 and offset from the axis 704 in the direction of second edge 722.

At the second notched portion 806, sheet 700 includes edge 814 extending in a direction perpendicular to second edge 722 and perpendicular to axis 706, from second edge 722 toward the first edge 720. Edge 814 is positioned parallel with terminating edge 710 and parallel with axis 730. The sheet 700 further includes edge 812 positioned at the second notched portion 806, with the edge 812 joined to edge 814 and positioned parallel with the second edge 722 and axis 706. The edge 812 is positioned perpendicular to the terminating edge 710 and axis 730, and extends in a direction from the terminating edge 710 of the sheet 700 toward the opposing end of the sheet 700. Edge 812 is positioned along axis 802 and is parallel with the axis 802, with the axis 802 being parallel to axis 706 and offset from the axis 706 in the direction of first edge 720.

Although the first notched portion 804 includes edge 810 positioned perpendicular to edge 808 and the second notched portion 806 includes edge 812 positioned perpendicular to edge 814, in other examples one or more of the edge 810, edge 808, edge 812, and edge 814 may be curved relative to the other edges. For example, edge 814 and/or edge 810 may be curved with a curvature similar to curvature 514 shown by FIG. 5 and described above.

FIG. 9 shows the sheet 700 in a partially folded configuration. Specifically, the sheet is folded along axis 900 and axis 902, with the axis 900 offset from axis 800 toward the central axis 702, and with axis 902 offset from axis 802 toward the central axis 702. In this configuration, a second face 908 of the sheet 700 is shown.

In order to form the coolant tube 1002 as shown by FIG. 10, the sheet 700 shown by FIG. 9 is additionally folded along axis 904 and axis 906. The first notched portion 804 and second notched portion 806 shown by FIGS. 8-9 are aligned with each other and positioned adjacent to each other via the folding in order to form notch 1000 of partition 1010. Notch 1000 may be similar to the notch 300 described above with reference to FIGS. 3-6, and partition 1010 may be similar to the partition 302 described above with reference to FIGS. 3-6.

Figure 11:
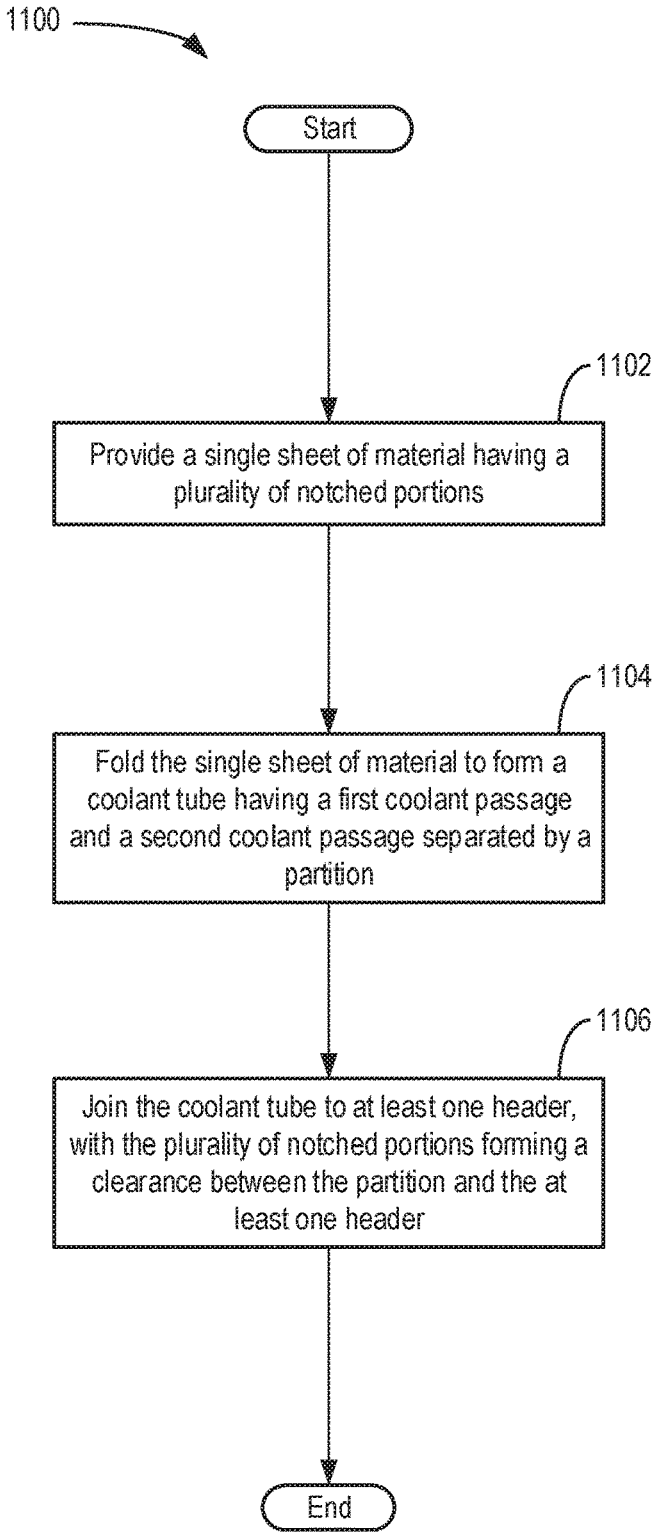
FIG. 11 shows a flowchart illustrating a method of manufacturing a notched tube for a heat exchanger.

FIG. 11 shows a method 1100 of manufacture for a heat exchanger, such as the heat exchanger 200 described above. In some examples, tubes of the heat exchanger (e.g., tube 206) may be formed according to the sequential stages of manufacture shown by FIGS. 7-10 and described above.

At 1102, the method includes providing a single sheet of material having a plurality of notched portions. For example, the single sheet of material may be similar to the sheet 700 described above with reference to FIG. 8, with the sheet including notched portions at opposing corners (e.g., first notched portion 804 and second notched portion 806). Providing the single sheet of material with the plurality of notched portions may include cutting the notched portions from the sheet that does not include notched portions, in one example. In another example, providing the single sheet of material with the plurality of notched portions may include molding the sheet to include the notched portions. Each corner of the single sheet of material may include a corresponding notched portion.

The method continues from 1102 to 1104 where the method includes folding the single sheet of material to form a coolant tube having a first coolant passage and a second coolant passage separated by a partition. In one example, the coolant tube may be similar to coolant tube 206 and/or coolant tube 1002 described above, the first coolant passage may be similar to first passage 406 described above with reference to FIGS. 3-4 and 6, the second coolant passage may be similar to second passage 408 described above with reference to FIGS. 3-4 and 6, and the partition may be similar to partition 302 described above with reference to 3-6 and/or partition 1010 shown by FIG. 10. For example, at 1102, the single sheet may be in the unfolded configuration shown by FIG. 8, and at 1104, the sheet may be first partially folded as shown by FIG. 9, and then fully folded to form the coolant tube as shown by FIG. 10. Folding the single sheet of material may include positioning opposing notched portions of the sheet (e.g., first notched portion 804 and second notched portion 806) adjacent to each other to form at least one notch of the coolant tube (e.g., notch 300 shown by FIG. 3-6, or notch 1000 shown by FIG. 10).

The method continues from 1104 to 1106 where the method includes joining the coolant tube to a header, with the plurality of notched portions forming a clearance between the partition and the header. In one example, the header may be similar to header 204 or header 224 shown by FIG. 2 and described above. Joining the coolant tube to the header may include coupling the coolant tube to one or more openings of the header, such as opening 407 shown by FIG. 3. The coolant tube may be fused (e.g., welded, brazed, etc.) to the header plate to join the coolant tube to the header. In one example, joining the coolant tube to the header may include joining a first end of the coolant tube to an opening of a first header and joining a second end of the coolant tube to an opening of a second header. For example, the coolant tube may be similar to tube 206 described above with reference to FIGS. 2-6, and end 360 of the tube 206 (shown by FIGS. 3-5) may be joined to header 204 (e.g., welded, brazed, etc. to header 204). An opposing, second end of the coolant tube may be joined to header 224 (e.g., welded, brazed, etc. to header 224).

FIGS. 2-10 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, by configuring the cooling tubes of the heat exchanger to include partitions with notches, the amount of thermal stress on the cooling tubes may be reduced. The notches may reduce an amount of heat transferred to the partitions by other components of the heat exchanger and may reduce temperature fluctuations of the cooling tubes. Durability of the cooling tubes and heat exchanger may be increased.

The technical effect of forming the cooling tubes with partitions that include the notch is to reduce a thermal load at the location of the notch.

In one embodiment, a heat exchanger comprises: a header; and a coolant tube including first and second coolant passages arranged adjacent to one another and separated by a partition, a first end of the coolant tube coupled to the header, the partition including a notch arranged at the first end, the notch extending into the coolant tube from the header. In a first example of the heat exchanger, the notch forms a pass-through between the first and second coolant passages at the first end. A second example of the heat exchanger optionally includes the first example, and further includes wherein the notch extends a length into the first and second coolant passages, away from the header. A third example of the heat exchanger optionally includes one or both of the first and second examples, and further includes wherein a remainder of the partition adjacent to the notch spans a height of the coolant tube and completely separates the first and second coolant passages from one another. A fourth example of the heat exchanger optionally includes one or more or each of the first through third examples, and further includes wherein the partition is disposed between a lower surface of the coolant tube and an opposing, upper surface of the coolant tube and includes a terminating edge at the first end that does not span an entire height of the coolant tube from the lower surface to the upper surface. A fifth example of the heat exchanger optionally includes one or more or each of the first through fourth examples, and further includes wherein a wall forming the first and second coolant passages includes each of the lower surface and the upper surface, and wherein a thickness of the partition is at least twice a thickness of the wall. A sixth example of the heat exchanger optionally includes one or more or each of the first through fifth examples, and further includes wherein the partition further includes a first surface joined to the terminating edge and extending into the coolant tube from the terminating edge. A seventh example of the heat exchanger optionally includes one or more or each of the first through sixth examples, and further includes wherein the partition further includes a second surface joined to the first surface and extending toward the upper surface or lower surface and away from the terminating edge. An eighth example of the heat exchanger optionally includes one or more or each of the first through seventh examples, and further includes wherein the first surface is flat and without curvature, and wherein the second surface curves toward the upper surface or lower surface. A ninth example of the heat exchanger optionally includes one or more or each of the first through eighth examples, and further includes wherein the partition further comprises a second notch arranged at a second end of the coolant tube and extending into the coolant tube from the second end, with the second end opposing the first end.

In another embodiment, a heat exchanger comprises: a first header and a second header arranged at opposite ends of the heat exchanger; a plurality of coolant tubes, where each coolant tube includes two coolant passages arranged adjacent to one another and separated by a partition, the partition and coolant tube each extending between and coupled to the first header and second header, the partition including a first notch at a first end of the partition and a second notch at an opposing, second end of the partition, with the first notch extending into the coolant tube from the first header and the second notch extending into the coolant tube from the second header. In a first example of the heat exchanger, each of the first notch and the second notch extends across only a portion of a height of the partition, the height defined perpendicular to direction of flow through two coolant passages. A second example of the heat exchanger optionally includes the first example, and further includes wherein the partition is centered between the two coolant passages, with each coolant passage of the two coolant passages having a same width in a direction perpendicular to the height. A third example of the heat exchanger optionally includes one or both of the first and second examples, and further includes a plurality of fins positioned between adjacent coolant tubes of the plurality of coolant tubes. A fourth example of the heat exchanger optionally includes one or more or each of the first through third examples, and further includes wherein the first notch is positioned at an upper surface of the coolant tube and the second notch is positioned at a lower surface of the coolant tube, with the partition joined to the lower surface and not the upper surface at the first notch, and with the partition joined to the upper surface and not the lower surface at the second notch. A fifth example of the heat exchanger optionally includes one or more or each of the first through fourth examples, and further includes wherein the first header includes a first header plate comprising a first plurality of openings, the second header includes a second header plate comprising a second plurality of openings, and wherein each tube of the plurality of tubes is coupled to a corresponding opening of the first plurality of openings and a corresponding opening of the second plurality of openings.

In one embodiment, a method of manufacture comprises: providing a single sheet of material having a plurality of notched portions; folding the single sheet of material to form a coolant tube having a first coolant passage and a second coolant passage separated by a partition; and joining the coolant tube to at least one header, with the plurality of notched portions forming a clearance between the partition and the at least one header. In a first example of the method, each corner of the single sheet of material includes a corresponding notched portion of the plurality of notched portions. A second example of the method optionally includes the first example, and further includes wherein folding the single sheet of material includes positioning opposing notched portions of the plurality of notched portions adjacent to each other to form at least one notch of the coolant tube. A third example of the method optionally includes one or both of the first and second examples, and further includes wherein joining the coolant tube to the at least one header includes joining a first end of the coolant tube to a first header and joining a second end of the coolant tube to a second header.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A heat exchanger, comprising:

a header;

a coolant tube including first and second coolant passages arranged adjacent to one another and separated by a partition, a first end of the coolant tube coupled to the header, the partition including a notch arranged at the first end, the notch extending from the first end of the coolant tube in a direction of a second, opposing end of the coolant tube, wherein the notch is longer in a direction parallel with the partition than perpendicular to the partition, and wherein the notch extends into the coolant tube from the header; and a plurality of sinusoidal fins commencing at a back surface of the header and positioned below the coolant tube with a first axis aligned with each fin of the sinusoidal fins and a second axis intermediate a pair of fins of the sinusoidal fins;

wherein the partition is disposed between a lower surface of the coolant tube and an opposing, upper surface of the coolant tube and includes a terminating edge at the first end that does not span an entire height of the coolant tube from the lower surface to the upper surface; and wherein the notch terminates at the second axis intermediate a pair of fins of the sinusoidal fins.

2. The heat exchanger of claim 1, wherein the notch forms a pass-through between the first and second coolant passages at the first end.

3. The heat exchanger of claim 1, wherein the notch extends a length into the first and second coolant passages, away from the header.

4. The heat exchanger of claim 1, wherein a remainder of the partition adjacent to the notch spans a height of the coolant tube and completely separates the first and second coolant passages from one another.

5. The heat exchanger of claim 1, wherein a wall forming the first and second coolant passages includes each of the lower surface and the upper surface, and wherein a thickness of the partition is at least twice a thickness of the wall.

6. The heat exchanger of claim 1, wherein the partition further includes a first surface at a location of the notch parallel to the upper surface and lower surface of the partition and joined to the terminating edge and extending into the coolant tube from the terminating edge.

7. The heat exchanger of claim 6, wherein the partition further includes a second surface extending from the first surface at a first end of the first surface opposite the terminating edge, the second surface extending toward the upper surface or lower surface and away from the terminating edge.

8. The heat exchanger of claim 7, wherein the first surface is flat and without curvature, and wherein the second surface curves toward the upper surface or lower surface.

9. The heat exchanger of claim 1, wherein the partition further comprises a second notch arranged at a second end of the coolant tube and extending into the coolant tube from the second end, with the second end opposing the first end.

10. A heat exchanger, comprising:

a first header and a second header arranged at opposite ends of the heat exchanger;

a plurality of coolant tubes, where each coolant tube includes two coolant passages arranged adjacent to one another and separated by a partition, the partition and coolant tube each extending between and coupled to the first header and second header, the partition including a first notch at a first end of the partition and a second notch at an opposing, second end of the partition, with the first notch extending into the coolant tube from the first header and the second notch extending into the coolant tube from the second header, wherein at least one of the first notch or the second notch is longer in a direction parallel with the partition than perpendicular to the partition, and wherein the first notch extends from a first end of the coolant tube in a direction of a second end of the coolant tube; and a plurality of sinusoidal fins commencing at a back surface of the header and positioned between adjacent coolant tubes of the plurality of coolant tubes with a first axis aligned with each fin of the sinusoidal fins and a second axis intermediate a pair of fins of the sinusoidal fins;

wherein the partition is disposed between a lower surface of the coolant tube and an opposing, upper surface of the coolant tube and includes a terminating edge at the first end that does not span an entire height of the coolant tube from the lower surface to the upper surface; and wherein at least the first notch terminates at the second axis intermediate a pair of fins of the sinusoidal fins.

11. The heat exchanger of claim 10, wherein each of the first notch and the second notch extends across only a portion of a height of the partition, the height defined perpendicular to direction of flow through two coolant passages.

12. The heat exchanger of claim 11, wherein the partition is centered between the two coolant passages, with each coolant passage of the two coolant passages having a same width in a direction perpendicular to the height.

13. The heat exchanger of claim 10, wherein the first notch is positioned at an upper surface of the coolant tube and the second notch is positioned at a lower surface of the coolant tube, with the partition joined to the lower surface and not the upper surface at the first notch, and with the partition joined to the upper surface and not the lower surface at the second notch.

14. The heat exchanger of claim 10, wherein the first header includes a first plurality of openings, the second header includes a second plurality of openings, and wherein each coolant tube of the plurality of coolant tubes is coupled to a corresponding opening of the first plurality of openings and a corresponding opening of the second plurality of openings.

15. The heat exchanger of claim 1, wherein there are no notches in a partition of a second, opposing end of the coolant tube.

16. The heat exchanger of claim 1, further comprising at least one other tube not including the notch.

* * * * *